United States Patent [19]

Runkle

[11] Patent Number: 5,046,931

[45] Date of Patent: Sep. 10, 1991

[54] RADIAL GEAR DRIVEN PISTON PUMP

[75] Inventor: Dean E. Runkle, LaPorte, Ind.

[73] Assignee: Allied-Signal Inc., Morristown, N.J.

[21] Appl. No.: 549,838

[22] Filed: Jul. 9, 1990

[51] Int. Cl.[5] ..... F04B 19/02

[52] U.S. Cl. ..... 417/463; 92/245; 417/462; 91/492

[58] Field of Search ..... 417/462, 463; 91/474, 91/492, 498; 92/240, 245

[56] References Cited

U.S. PATENT DOCUMENTS

| | | | |
|---|---|---|---|
| 2,651,999 | 9/1953 | Harrington | 103/161 |
| 2,731,114 | 1/1956 | Lambert et al. | 92/245 |
| 3,661,057 | 5/1972 | Rogov | 91/498 |
| 3,695,147 | 10/1972 | Seisennop et al. | 91/498 |
| 4,310,291 | 1/1982 | Green et al. | 417/435 |
| 4,401,082 | 8/1983 | Leblanc | 123/447 |
| 4,445,825 | 5/1984 | Budecker | 417/462 |
| 4,486,154 | 12/1984 | Duplat et al. | 417/487 |
| 4,505,652 | 3/1985 | Burgdorf et al. | 417/462 |
| 4,555,223 | 11/1985 | Budecker et al. | 417/462 |
| 4,660,522 | 4/1987 | Babitzka | 123/450 |
| 4,662,337 | 5/1987 | Eheim | 123/450 |
| 4,709,673 | 12/1987 | Babitzka | 123/299 |
| 4,758,134 | 7/1988 | Budecker et al. | 417/462 |
| 4,780,068 | 10/1988 | Brown, Jr. | 417/462 |
| 4,846,631 | 7/1989 | Parrott | 417/463 |
| 4,850,825 | 7/1989 | Budecker | 417/538 |
| 4,920,859 | 5/1990 | Smart et al. | 91/498 |
| 4,982,566 | 1/1991 | von Kaler et al. | 417/462 |

*Primary Examiner*—Leonard E. Smith

*Assistant Examiner*—Michael I. Kocharov

*Attorney, Agent, or Firm*—Larry J. Palguta; Ken C. Decker

[57] ABSTRACT

The radial gear driven piston pump (10) comprises a stationary pintle or pin (40) having a rotatable rotor (30) mounted thereon. The rotor (30) and pintle (40) are disposed within a pumping bore (18) that is eccentrically aligned relative to bore extensions (28) receiving the pintle (40). The rotor (30) is driven by an offset motor (12) which engages a periphery of the rotor (30). The pintle (40) has therein two pairs of longitudinal passages comprising supply (46, 53) and discharge (47, 54) channels which communicate with respective intake (41, 43) and exhaust (42, 44) ports within the pump housing (16). The rotor (30) has sets of axially offset pistons (90, 100) received within piston cavities (93, 93'). Each set of piston (90, 100) comprises a metal piston cap (95) having a central opening (90) which receives a longitudinal extension (97) of a piston sealing ring (98). Each piston sealing ring (98) has an opening (111) extending into the longitudinal extension (97) in order to house a spring which engages a recess (34) of the piston cavity (93) to bias the piston outwardly into engagement with a bearing mechanism (70) disposed within the pumping bore (18). Each piston cavity (93, 93') has an end opening (94, 94') communicating intermittently with the associated supply (46, 53) and discharge (47, 54) channels as the rotor (30) rotates about the pintle (40). The pump (10) provides a dual channel pumping function with as many pistons as desired for each channel.

15 Claims, 1 Drawing Sheet

RADIAL GEAR DRIVEN PISTON PUMP

The present invention relates generally to a radial piston pump, and in particular to a dual channel radial piston pump suitable for adaptive braking systems.

Vehicle adaptive braking systems utilize an incompressable fuild for actuation and deactuation of the brakes of the vehicle. The incompressable fluid is maintained under pressure and then modulated by appropriate mechanisms in order to modulate braking according to road conditions. The incompressible fluid is usually maintained under pressure by means of a pump disposed within the adaptive braking system. It is highly desirable to provide a very compact, quiet, and low-cost pump which provides one or more separate pumping sections powered by a single electric motor. It is important that the pump operate efficiently and quietly, and require as little space as possible. It is also highly desirable that the separate channels of the pump be able to transmit different volumes of fluid according to the requirements of the particular adaptive braking system.

The present invention provides a solution to the above problems by providing a radial piston pump for transmitting fluid therethrough, said pump comprising a pintle having longitudinal supply and discharge channels therein, intake and exhaust ports disposed within said pump for communication with said channels in the pintle, a rotor having a central opening disposed about said pintle and carrying radial piston means, the radial piston means disposed within a piston cavity communicating with the central opening of the rotor which receives said pintle, the piston means comprising an annular-shaped piston cap having a central opening at one radial side, an elastomeric piston sealing ring having a longitudinal extension received seatingly within said central opening of the piston cap, the sealing ring having a central opening communicating with one end of the ring and extending within said longitudinal extension, and resilient means disposed within said cavity and extending between one end of said cavity and an end of said longitudinal extension to bias said piston sealing ring and piston cap radially outwardly away from said pintle, the piston sealing ring effecting a seal with an area of said cavity located radially inwardly of said piston cap, so that reciprocal movement of said piston means as said rotor rotates varies the volume of said piston cavity such that fluid drawn in through said intake port and supply channel is carried rotatably by said cavity and discharged through said discharge channel and exhaust port.

Figure 2:
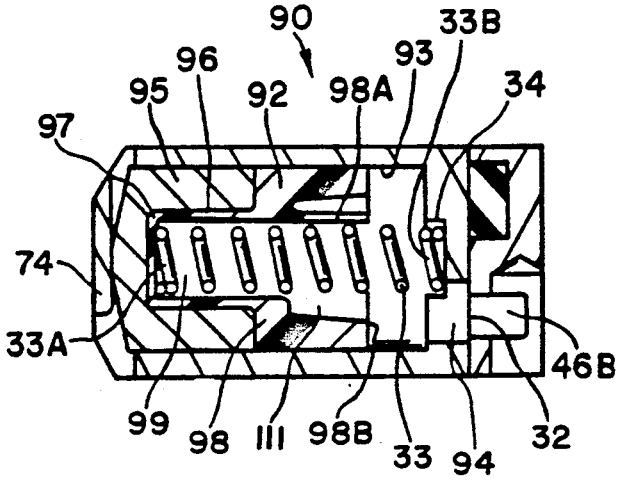
Figure 1:
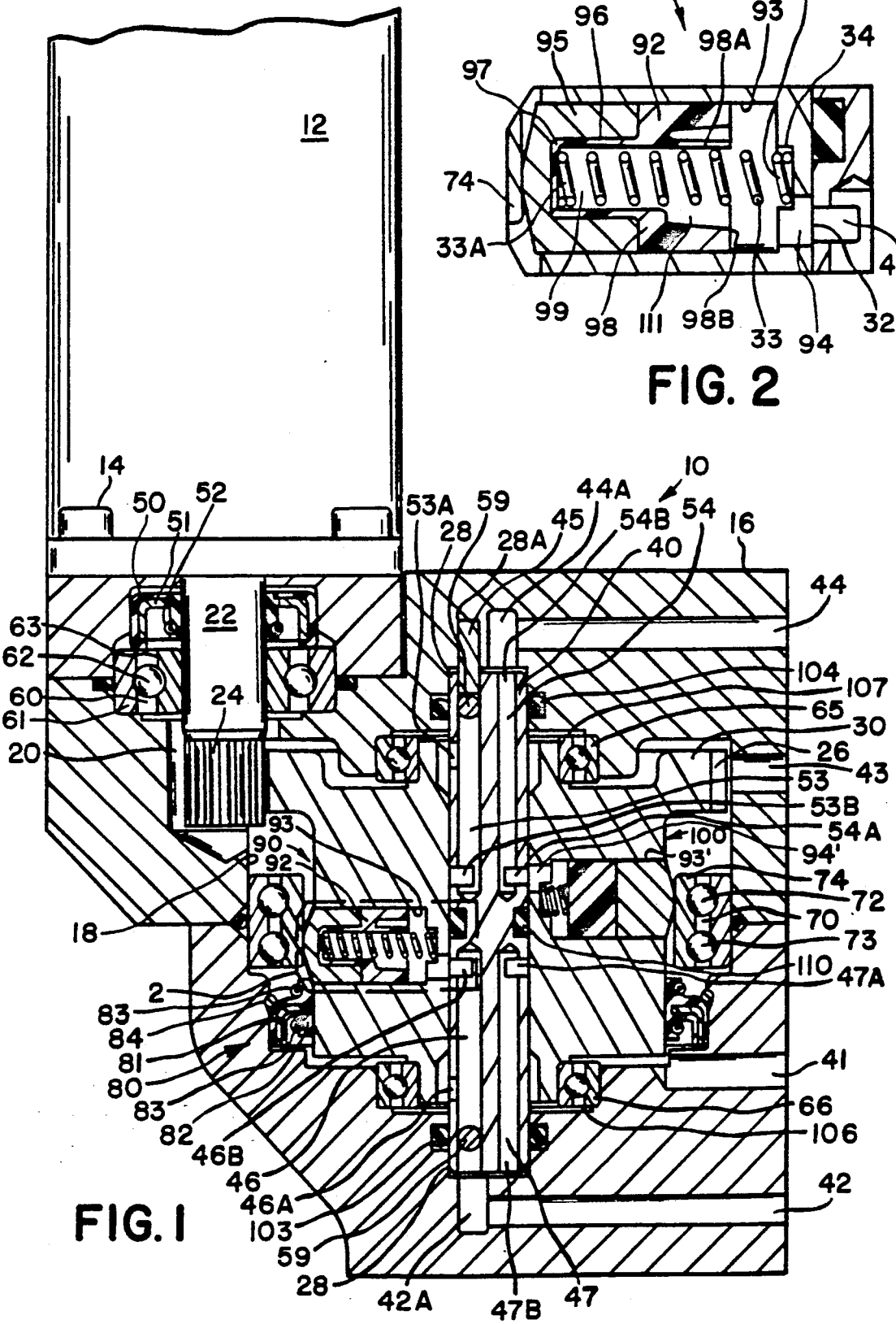

One way of carrying out the invention is described in detail below with reference to the drawings, in which:

FIG. 1 illustrates a partial section view of the pump assembly and motor mechanism, and FIG. 2 is an enlarged section view of the piston cavity and piston means disposed therein.

The pump of the present invention is indicated generally by reference numeral 10 in FIG. 1. Pump 10 includes a motor 12 which is fixed by bolts 14 to a two-piece pump housing 16. Pump housing 16 includes a pumping bore 18 which communicates with an opening 20 that receives a motor shaft 22. Motor shaft 22 includes gear teeth 24 which mesh with peripheral gear teeth 26 of rotor 30 disposed within pumping bore 18. Pumping bore 18 communicates with opposite axial bore extensions 28 which provide a seat for stationary rotor pin or pintle 40. Housing 16 includes a lower intake port 41 associated with lower exhaust port 42, and an upper intake port 43 associated with an upper exhaust port 44. The exhaust ports 42, 44 each terminate in an axial chamber 42A and 44A, respectively, which communicate with axial bore extensions 28. The rotor pin or pintle 40 includes a fixing pin 45 which is received within a correspondingly shaped bore hole 28A so that pin 40 is fixed stationarily relative to housing 16. Drive shaft 22 of motor 12 extends through a seal 50 which includes a metallic reinforcement 51 and a garter spring 52 so that seal 50 remains snug against drive shaft 22 and prevents fluid flow therearound. Shaft 22 is received within bearing means 60 which includes an outer bearing ring 61, bearing balls 62, and inner bearing ring 63. In similar manner, rotor 30 includes at each axial end a similar bearing mechanism 65 and 66, so that the rotor is rotatably journaled within pumping bore 18. Pumping bore 18 includes therein a bearing mechanism 70 having two sets of bearing balls 72, 73 and an inner ring 74 which engages pistons disposed within rotor 30. A sealing mechanism 80 comprising a metallic reinforcement 81 coupled with a seal 82 having two garter springs 83 thereabout engages the bottom circumferential area of rotor 30. Sealing mechanism 80 also abuts snap ring retainer 84. Rotor 30 includes separate sets of pistons 90 and 100. Piston set 90 may comprise one or more pistons, and in the present pump it comprises three equally spaced-apart piston means 92 which are received within piston cavities 93. Piston cavities 93 each communicate with a respective cavity opening 94 which communicates with the central opening 32 of rotor 30. Disposed within each piston cavity 93 is the piston means 92 which comprises an annular metal piston cap 95 having a central opening 96 which receives therein a longitudinal extension 97 of an elastomeric piston sealing ring 98. Elasomeric sealing ring 98 may be made of Teflon ® and includes a central opening 99 for receiving therein resilient means 33. Resilient means 33 is housed at one end within the longitudinal extension 97 and the other end within a cavity recess 34. Resilient means 33 biases the piston sealing ring into continuous engagement with the metal piston cap 95 so that the two will not separate from each other. Metal piston cap 95 engages the inner ring 74 of bearing means 70.

Pistons 100 are disposed within the associated piston cavities 93' which communicates with their associated cavity openings 94', and the structure of each piston means and cavity is identical to that described above for piston means 92. Rotor pin or pintle 40 comprises a longitudinal pin having two sets of associated passages. A lower set of passages comprises supply passage 46 having openings 46A and 46B, with opening 46B communicating intermittently with cavity opening 94, and discharge passage 47 having discharge openings 47A and 47B. Discharge passage opening 47A communicates intermittently with rotating cavity opening 94 and discharge passage opening 47B communicates with bore extension 28 and axial chamber 42A. Disposed around the lower end of pin 40 is a seal 103. Likewise, the upper end of pin 40 includes thereabout a seal 104 and the pin includes a pair of associated passages 53 and 54. Supply passage 53 includes an opening 53A that communicates with the intake port 43, and an opening 53B communicates intermittently with the rotating cavity opening 94'. Longitudinal or discharge passage 54 includes an opening 54A which communicates intermittently with the rotating cavity opening 94', and an end opening 54B communicates with axial chamber 44A of exhaust port 44. Each of the supply passages 46, 53 has one end blocked by a ball 59, and communicates with its respective intake port by means of a respective intake fluid supply area 106, 107. The bearing means 65, 66 each comprise an inner bearing ring and an outer bearing ring separated by a plurality of ball bearings. Thus, fluid flowing through the intake ports 41, 43 may flow between the bearings within bearing means 65, 66 and flow to the fluid supply areas 106, 107.

Pump 10 is operated by motor 12 such that teeth 24 of drive shaft 22 cause rotor 30 to rotate about stationary rotor pin 40. Referring to piston means 92, as rotor 30 rotates about pin 40 piston means 92 reciprocates with piston cavity 93. This is caused by the eccentric position of pumping bore 18 relative to the position of the longitudinal bore extensions 28 which house the rotor pin 40 that positions rotor 30. Thus, piston means 92 reciprocates within piston cavity 93 such that in the position shown in FIG. 1, fluid supplied via intake port 41 to supply area 106 and pin opening 46A, supply or longitudinal passage 46, and opening 46B, is drawn through cavity opening 94 and into cavity 93 as piston means 92 moves radially outwardly away from rotor pin 40. As the rotor rotates, piston means 92 is depressed by bearing means 70 so that the piston means moves into piston cavity 93 and when disposed opposite opening 47A of longitudinal discharge passage 47, fluid within cavity 93 is forced out into passage 47 for communication with axial chamber 42A and exhaust port 42. Piston means 100 operates in the same manner. The rotor pin 40 includes a central seal 110 which divides the pumping channels one from another. Likewise, sealing means 80 separates fluid supplied via intake port 41 from fluid supplied via intake port 43, this being accomplished by positioning sealing means 80 between the lower end of the pumping bore lB and the piston sets 90, 100. Fluid supplied via the intake port 43 could not enter piston cavity 93 because of sealing effected by piston sealing ring 98.

Referring to FIG. 2, an enlarged illustration of piston means 92 shows that piston sealing ring 98 includes the longitudinal extension 97 which houses one end 33A of spring 33 while an opposite end 33B of the spring is housed within cavity recess 34. Ring 98 includes three equally spaced-apart spring guide ribs 98A which extend between end 98B of ring 98 and an end of ring opening 111 to provide positioning guidance of resilient means 33. When fluid is received within cavity 93 and then pushed out of the cavity by the movement of piston means 92 rightwardly in FIG. 2, the piston sealing ring expands slightly radially outwardly to effect a sealing engagement with the surface of cavity 93 so that fluid does not leak past piston means 92 and to the intake fluid area 107.

The pump of the present invention utilizes a very small motor that can drive the pump rotor by means of a gear reduction. Any gear ratio may be utilized. Also, the piston means of piston sets 90 and 100 may have different diameters so that different volumes of fluid can be pumped by the respective channels of the pump. This will compensate for the normally lower fluid consumption required for the rear wheels of a vehicle having an adaptive braking system. The fact that the piston diameters of the piston sets are different will not cause any unbalanced vibration within the pump. The pump of the present invention can also be easily converted to a single channel pump by merely connecting the exhaust ports 42, 44 to a single connection and removing the sealing means 80 so that each of the intake ports 41, 43 communicate fluid commonly with the supply passages 46, 53. The pump of the present invention would utilize a multiple number of pistons for each respective channel in order to effect a more constant pressure ripple, reduce noise, and provide a more efficient pump for an adaptive braking system. The overall physical size of the pump and motor would be greatly reduced and this further aids in providing a compact adaptive braking system package for installation on a vehicle.

I claim:

1. A radial Piston pump for transmitting fluid therethrough, said pump comprising a pintle having longitudinal supply and discharge channels therein, intake and exhaust ports disposed within said pump for communication with said channels in the pintle, a rotor having a central opening disposed about said pintle and carrying radial piston means, the radial piston means disposed within a piston cavity communicating with the central opening of the rotor which receives said pintle, the piston means comPrising an annular-shaped piston cap having a central opening at one radial side, an elastomeric piston sealing ring having a longitudinal extension received seatingly within said central opening of the piston cap, the sealing ring having a central opening communicating with one end of the ring and extending within said longitudinal extension, and resilient means disposed within said cavity and extending between one end of said cavity and an end of said longitudinal extension to bias said piston sealing ring and piston cap radially outwardly away from said pintle, the piston sealing ring effecting a seal with an area of said cavity located radially inwardly of said piston cap, so that reciprocal movement of said piston means as said rotor rotates varies the volume of said piston cavity such that fluid drawn in through said intake port and supply channel is carried rotatably by said cavity and discharged through said discharge channel and exhaust port.

2. The pump in accordance with claim 1, wherein the piston sealing ring includes spring guide ribs disposed within said central opening of the ring in order to guide a portion of said resilient means extending from said longitudinal extension.

3. The pump in accordance with claim 2, wherein said piston cavity includes at one end a recess which provides a seat for an end of the resilient means opposite said longitudinal extension.

4. The pump in accordance with claim 1, wherein said exhaust port includes an end portion disposed in axial alignment with said pintle to communicate with said discharge channel.

5. The pump in accordance with claim 1, wherein the pump comprises a two channel pump having a seal about the pintle, a second pair of supply and discharge channels communicating with respective intake and exhaust ports, second piston means disposed in an associated piston cavity, and sealing means disposed about said rotor and located between an end of said rotor and both piston means.

6. The pump in accordance with claim 5, wherein the pump includes a motor having drive shaft means that engages a Periphery of said rotor to effect rotation of the rotor about the pintle.

7. The pump in accordance with claim 1, wherein the pintle is fixed within the pump by means of a fixing pin received within one of said channels.

8. A pump assembly, comprising a housing having a pumping bore disposed therein, a motor drive cavitY disposed in said housing and communicating with said pumping bore, a rotor disposed within said pumping bore and having a central opening, a rotor pin disposed within said pumping bore and central opening of the rotor and stationary relative to said housing, a motor connected with said housing and having drive shaft means extending within said cavity to engage a peripheral portion of said rotor, the pumping bore being offset relative to said rotor pin, passages comprising intake and exhaust ports communicating with said pumping bore, the rotor pin having therein first and second longitudinal passages disposed parallel to one another, each longitudinal passage having a radial opening communicating with a grooved periphery of the rotor pin, said first longitudinal passage including a second radial opening which communicates with said intake port, the second longitudinal passage having an opening at an axial end of said pin and communicating with said exhaust port, and the rotor having at least one piston means disposed therein, the piston means disposed within a piston cavity having an opening communicating with the central opening, the piston means comPrising a piston cap abutting a piston sealing ring which receives resilient means disposed between said piston sealing ring and an end of said piston cavity, the piston cap having a longitudinal opening therein and said piston sealing ring having a longitudinal extension extending therefrom and seated within said longitudinal opening of the piston cap, the resilient means extending into said longitudinal extension of the sealing ring, so that rotation of said rotor by said drive shaft means causes the piston to be rotated within said pumping bore whose offset relative to the rotor pin causes the piston means to reciprocate within the piston cavity such that fluid drawn into the piston cavity via the intake port and first longitudinal passage is transmitted about the pin and exhausted from the piston cavity into the second longitudinal passage and exhaust.

9. The pump in accordance with claim 8, wherein the pumping bore includes therein bearing means which is engaged by said piston cap.

10. The pump in accordance with claim 8, wherein the piston sealing ring includes a plurality of guide ribs within the ring and extending from one end of the ring toward an opposite end of the ring having said longitudinal extension, the guide ribs providing guiding for an end of said resilient means extending toward the one end.

11. The pump in accordance with claim 8, wherein the piston cavity includes an end recess which receives said end of the resilient means.

12. The pump in accordance with claim 8, wherein said piston cap is annular shaped and said piston sealing ring and longitudinal extension are annular shaped.

13. The pump in accordance with claim 8, wherein said exhaust port includes an end portion disposed in axial alignment with said rotor pin to communicate with said second longitudinal passage.

14. The pump in accordance with claim 13, wherein said pumping bore includes axially opposite end recesses which receive ends of said rotor pin which extend axially beyond associated axial ends of said rotor.

15. The pump in accordance with claim 14, wherein the pump comprises a dual channel radial piston pump wherein the rotor pin further includes a central seal thereabout, a second pair of longitudinal passages disposed therein communicating with respective intake and exhaust ports disposed in the housing, second piston means disposed within an associated piston cavity communicating with the associated longitudinal passages, and sealing means disposed about said rotor and located axially between one axial end of said pumping bore and both piston means.

* * * * *